United States Patent [19]

Uchimura

[11] Patent Number: 4,516,755

[45] Date of Patent: May 14, 1985

[54] HYDRAULIC WINCH CONTROL SYSTEM

[75] Inventor: Toshio Uchimura, Komatsu, Japan

[73] Assignee: Kabushiki Kaisha Komatsu Seisakusho, Tokyo, Japan

[21] Appl. No.: 384,414

[22] Filed: Jun. 2, 1982

[51] Int. Cl.[3] ..... B66D 1/00; B66D 1/30

[52] U.S. Cl. ..... 254/344; 254/361; 74/848

[58] Field of Search ..... 74/848, 813 C; 254/361, 254/291, 344, 349

[56] References Cited

U.S. PATENT DOCUMENTS

| | | | |
|---|---|---|---|
| 3,519,247 | 7/1970 | Christison | 254/150 |
| 3,764,111 | 10/1973 | Dummer | 254/361 |
| 3,776,518 | 12/1973 | Witwer | 254/361 X |
| 3,780,990 | 12/1973 | Edlund et al. | 254/361 |
| 3,819,156 | 6/1974 | Sieracki | 254/361 X |
| 4,088,305 | 5/1978 | Wineburner et al. | 254/349 X |
| 4,185,520 | 1/1980 | Henneman et al. | 254/344 X |
| 4,223,871 | 9/1980 | Braithwaite | 254/291 |
| 4,328,954 | 5/1982 | Logus | 254/344 |
| 4,345,742 | 8/1982 | Morfitt | 254/291 |

FOREIGN PATENT DOCUMENTS

| | | | |
|---|---|---|---|
| 646226 | 7/1964 | Belgium | 254/291 |
| 2455829 | 8/1976 | Fed. Rep. of Germany | 254/291 |
| 1439624 | 6/1976 | United Kingdom | 254/361 |
| 1558860 | 1/1980 | United Kingdom | 254/291 |

*Primary Examiner*—George H. Krizmanich
*Assistant Examiner*—Dirk Wright
*Attorney, Agent, or Firm*—Armstrong, Nikaido, Marmelstein & Kubovcik

[57] ABSTRACT

A hydraulic control system for a spooling drum of a reversible hoisting winch of the type having a bidirectional hydraulic motor for driving the drum via two planetary drives in series, with the final planetary drive having a spring-loaded brake which, when actuated hydraulically, allows the drum to freewheel. The control system comprises a shuttle valve connected between a pair of conduits through which the bidirectional drive motor is placed in selective communication with a first pump and a fluid drain by a motor control valve. Pilot-operated from the shuttle valve is a selector valve which, in response to the pilot signal supplied when the motor is in rotation in either direction, delivers pressurized hydraulic fluid from a second pump to a lubricating circuit of the planetary drives. When the motor control valve is neutralized, setting the drive motor out of rotation, the selector valve delivers the output of the second pump to the brake for freewheeling the winch drum.

4 Claims, 1 Drawing Figure

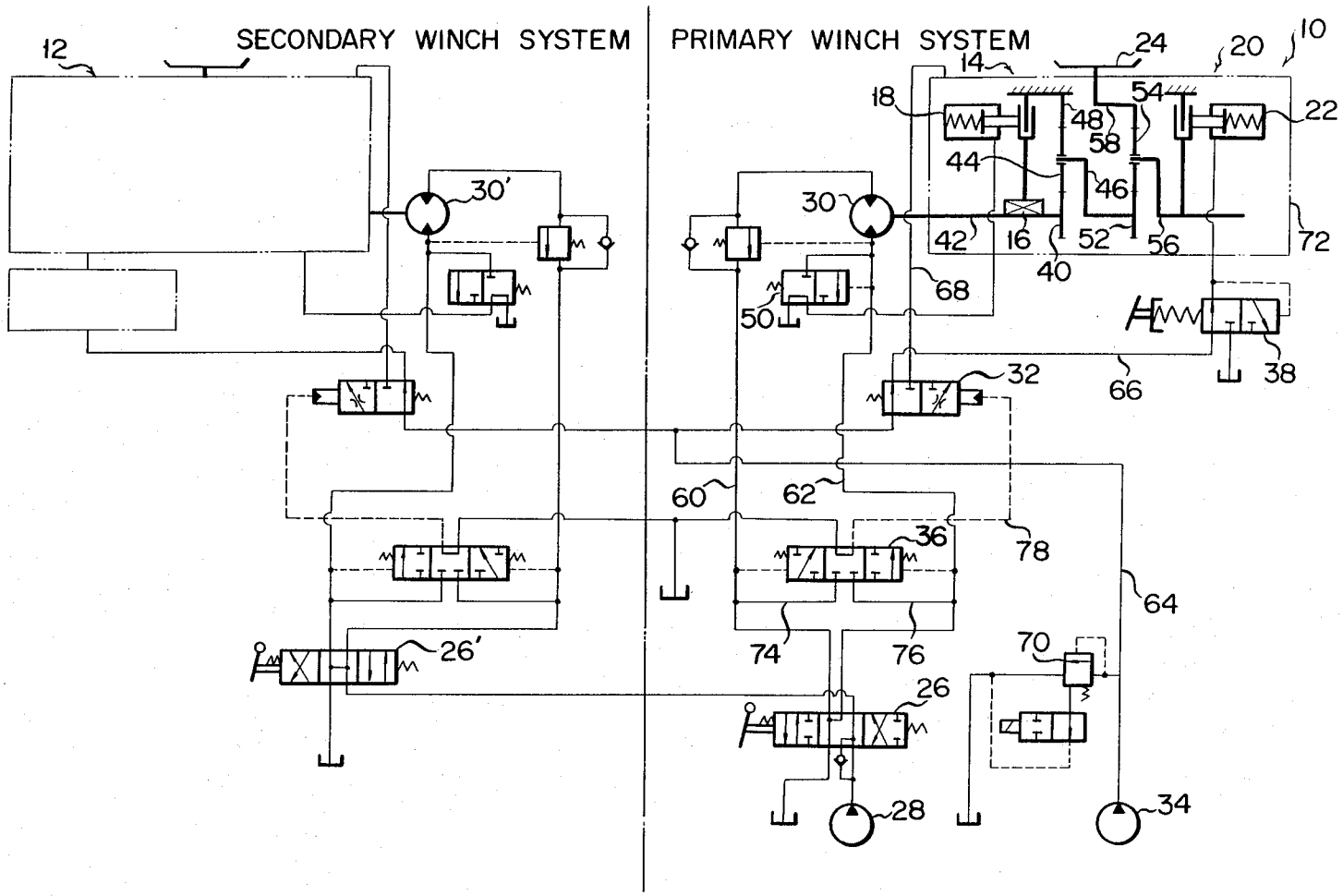
PRIMARY WINCH SYSTEM
SECONDARY WINCH SYSTEM
10
12
14
16
18
20
22
24
26
26'
28
30
30'
32
34
36
38
40
42
44
46
48
50
52
54
56
58
60
62
64
66
68
70
72
74
76
78

HYDRAULIC WINCH CONTROL SYSTEM

BACKGROUND OF THE INVENTION

The present invention pertains to a hydraulic control system for a hoisting winch, such as that of a mobile crane, and particularly for a reversible winch of the type having a spooling drum driven by a bidirectional hydraulic motor via planetary reduction means.

A hydraulic crane winch is known wherein the cable drum is driven by a bidirectional hydraulic motor via planetary gear drives connected in series, with the drum carried by the internal or ring gear of the final planetary gearing. A spring-loaded brake normally arrests the rotation of the planet carrier of the final planetary gearing, permitting the drum to rotate with the ring gear for the hoisting or controlled lowering of the load carried by the winch. The brake is released hydraulically, whereupon the drum becomes freewheeling, allowing the free fall of the load. The fluid pressure actuation of the brake is required only for the freewheeling of the drum.

SUMMARY OF THE INVENTION

This invention seeks in a hydraulic winch of the type described to make it possible to automatically make selective use of hydraulic fluid under pressure for the actuation of the freewheel brake and for the lubrication of pertinent parts of the winch.

Summarized briefly, the invention provides a hydraulic winch control system comprising first and second sources of hydraulic fluid under pressure. The first source delivers its output, via a motor control valve, to a bidirectional hydraulic motor driving a winch drum via planetary drive means including a freewheel brake of the above defined type. The second source is for the actuation of the freewheel brake. Interposed between the second source and the freewheel brake is a pilot-operated selector valve normally positioned to allow communication therebetween. In response to a pilot signal the selector valve directs the hydraulic fluid from the second source to a suitable lubricating circuit of the winch. The pilot signal is applied to the selector valve when the hydraulic motor is in rotation in either direction.

In a preferred embodiment a shuttle valve is connected between a pair of conduits extending between the motor control valve and the hydraulic motor. Upon delivery of the pressurized fluid from the first source to the motor, for the rotation of the latter in either direction, the shuttle valve operates to direct a fraction of the pressurized fluid to the selector valve as the pilot signal. Thus the output fluid of the second source is used for lubrication purposes when the hydraulic motor and therefore the winch drum are in rotation in either direction, and for the actuation of the freewheel brake and the consequent freewheeling of the drum when the motor control valve sets the motor out of communication with the first source.

The above and other features and advantages of this invention and the manner of attaining them will become more apparent, and the invention itself will best be understood, from a study of the following description of the preferred embodiment taken together with the attached drawing.

BRIEF DESCRIPTION OF THE DRAWING

The accompanying Drawing is a schematic illustration of a hydraulic control system for a mobile crane winch embodying the principles of the present invention.

DESCRIPTION OF THE PREFERRED EMBODIMENT

The Drawing shows the hydraulic control system of this invention as adapted for a dual winch system for a mobile crane, comprising a primary winch assembly 10 and a secondary winch assembly 12. The two winch assemblies are of identical design. They have their own control systems, distinguished from each other by the dot-and-dash line in the Drawing, each in accordance with the invention. It will be discerned from the Drawing that the control systems for the respective winch assemblies 10 and 12 are also alike, only with certain parts shared by both assemblies. Only the primary winch assembly 10 and its control system will therefore be described in detail, it being understood that the same description substantially applies to the secondary winch assembly 12 and its control system.

The primary winch assembly 10 is of the type comprising:

1. A first planetary drive 14 having a one-way clutch 16 and an associated brake 18 of the spring applied, hydraulically released type.
2. A second or final planetary drive 20 having a brake 22 which also is of the spring applied, hydraulically released type.
3. A cable spooling drum 24 driven by the final planetary drive 20.

The hydraulic control system for this primary winch assembly comprises:

1. A six-port, three-position motor control valve 26 to be actuated manually for controlling communication between a first fixed-displacement, unidirectional hydraulic pump 28 and a fixed-displacement, bidirectional hydraulic motor 30 coupled to the first planetary drive 14 of the winch assembly 10.
2. A pilot-operated, three-port, two-position selector valve 32 for selective delivery of pressurized fluid from a second fixed-displacement, unidirectional hydraulic pump 34 to the brake 22 of the final planetary drive 20 and to a lubricating circuit of the planetary drives 14 and 20.
3. A four-port, three-position shuttle valve 36 for pilot-operating the selector valve 32 in response to the delivery of the pressurized fluid from the first pump 28 to the motor 30.
4. A variable pressure-reducing valve 38 for controlling the fluid pressure applied to the brake 22.

We will first study the construction of the winch assembly 10 and then proceed to that of its control system. The first planetary drive 14 of the winch assembly 10 comprises a sun gear 40 driven from the bidirectional hydraulic motor 30 via a shaft 42, one or more planet gears 44 on a revolving planet carrier 46, and a fixed annulus 48. Provided to the shaft 42, the one-way clutch 16 when engaged functions to lock this shaft, and therefore the winch drum 24 against rotation in a direction to pay off the cable, not shown from the drum. The brake 18 normally holds the one-way clutch 16 applied under spring pressure. For releasing the brake 18, and so disengaging the one-way clutch 16, there is provided a pilot-operated release valve 50 yet to be explained.

When fluid actuated by this release valve, the brake 18 disengages the one-way clutch 16 thereby setting the winch drum 24 free to spin in the pay-off direction. The brake 18 will hereinafter be referred to as the clutch brake.

The final planetary drive 20 of the winch assembly 10 comprises a sun gear 52 coupled directly to the planet carrier 46 of the first planetary drive 14, one or more planet gears 54 on a planet carrier 56, and an annulus 58 rigidly carrying the winch drum 24. The brake 22 normally holds the planet carrier 56 against rotation in either direction under spring pressure. Consequently, with the rotation of the motor 30, the winch drum 24 revolves with the annulus 58 at a greatly reduced speed and in a direction determined by the motor. When actuated hydraulically, the brake 22 releases the planet carrier 56 and so sets the winch drum 24 freewheeling. The freewheeling drum will allow a free fall of any load carried by the winch. The brake 22 will hereinafter be referred to as the freewheel brake in contradistinction to the clutch brake 18.

Next to be discussed is the hydraulic control system for the winch assembly 10 of the foregoing configuration. Driven by a prime mover, not shown, the first pump 28 puts out hydraulic fluid under pressure for actuation of the bidirectional motor 30 via the motor control valve 26. When actuated to the left from its illustrated center position, the motor control valve 26 delivers the pressurized fluid from the first pump 28 to the motor 30 by way of a conduit 60 thereby setting the motor into rotation in a hoisting direction. When actuated to the right, on the other hand, the motor control valve directs the pressurized fluid from the first pump to the motor via a conduit 62 thereby causing motor rotation in a lowering direction. The motor control valve when in neutral passes the pressurized fluid on to the control circuit for the secondary winch assembly 12, in order to allow its motor 30' to be set into and out of rotation in a desired direction under the control of a motor control valve 26'.

The aforesaid release valve 50 is connected between the conduit 62 and the fluid chamber of the clutch brake 18 of the first planetary drive 14. Normally closed and holding the clutch brake 18 in communication with the fluid drain, the release valve is pilot operated by the pressurized fluid in the conduit 62. As has been mentioned, the pressurized fluid flows through the conduit 62 for causing rotation of the motor 30 in the lowering direction. Thus the release valve 50 causes the clutch brake 18 to disengage the one-way clutch 20 when the motor 30 starts rotation in the lowering direction, making it possible for the winch drum 24 to revolve in the direction to lower the load in a controlled manner. The one-way clutch locks the drum against rotation in the lowering direction when it is revolving in the hoisting direction, as well as when it is out of rotation.

One of the features of the present invention resides in the selector valve 32 pilot-operated from the shuttle valve 36. The selector valve 32 has: (a) an inlet port in communication with the second pump 34 by way of a conduit 64; (b) a first outlet port in communication with the freewheel brake 22 of the final planetary drive 20 by way of a conduit 66; and (c) a second outlet port in communication with the lubricating circuit by way of a conduit 68. The conduit 64 is provided with a relief valve 70 for bleeding off excessive pressure in the output circuit of the second pump 34, whereas the conduit 66 is provided with the variable pressure reducing valve 38 for the controlled delivery of the pressurized fluid to the freewheel brake 22.

The selector valve 32 is normally positioned to pass the pressurized fluid from the second pump 34 to the freewheel brake 22 via the variable pressure reducing valve 38. When pilot actuated, the selector valve directs the output from the second pump on to the conduit 68 leading to the lubricating circuit within a casing 72 housing the first 14 and second 20 planetary drives.

For pilot-operating the selector valve 32 the shuttle valve 36 is connected between the conduits 60 and 62 extending between motor control valve 26 and motor 30. The shuttle valve has its two inlet ports connected to the conduits 60 and 62 via their branches 74 and 76. Itself pilot-operated by the pressurized fluid in the conduits 60 and 62, the shuttle valve is displaced from its center position when the motor 30 is set into rotation in either direction, delivering a fraction of the pressurized fluid in either of the conduits 60 and 62 to the selector valve 32 as the pilot signal by way of a conduit 78.

In operation, when the motor control valve 26 is in neutral as in the Drawing, the clutch brake 18 of the first planetary drive 14 is held applied under spring pressure, resulting in the engagement of the one-way clutch 16. The shuttle valve 36 remains centered because of the absence of fluid pressure in the conduits 60 and 62 and so holds the pilot conduit 78 in communication with the fluid drain. Consequently, if the second pump 34 is in operation, the selector valve 32 directs its output toward the freewheel brake 22 of the second planetary drive 20 via the variable pressure reducing valve 38. The freewheel brake 22 releases the planet carrier 56 of the final planetary drive 20 when thus activated hydraulically. Thereupon the winch drum 24 becomes isolated from the planetary gear trains and will revolve freely under any load exerted on the unshown cable running out from the drum. The operator may suitably operate the variable pressure reducing valve 38 to cause a gradual increase in the fluid pressure applied to the freewheel brake 22.

Let us assume that the motor control valve 26 has just been shifted to the left. The pressurized fluid from the first pump 28 flows through the conduit 60 to the motor 30, causing same to rotate in a forward direction. The release valve 50 stays in the illustrated closed position, blocking communication between the conduit 62 and the clutch brake 18 of the first planetary drive 14. Thus the one-way clutch 16 of the first planetary drive remains engaged under spring pressure. The shuttle valve 36, on the other hand, travels to the right in response to the fluid pressure in the conduit 60 and delivers a fraction of the pressurized fluid from that conduit to the selector valve 32 as the pilot signal. When so pilot-operated, the selector valve becomes displaced to the left and blocks communication between the second pump 34 and the freewheel brake 22 of the final planetary drive 20. Under spring pressure, therefore, the freewheel brake 22 locks the planet carrier 56 of the final planetary drive against rotation in either direction.

It is thus seen that upon shifting of the motor control valve 26 to the left, the first 14 and second 20 planetary drives transmit the forward rotation of the motor 30 to the winch drum 24, causing same to revolve at a reduced speed for winding up the cable. The one-way clutch 16, which remains engaged as aforesaid, functions to prevent revolution of the winch drum in the opposite direction under the load carried thereby. Also, during such hoisting operation, the selector valve 32 directs the pressurized fluid from the second pump 34 toward the lubricating circuit within the casing enclosing the planetary drives 14 and 20. The selector valve is constructed to control the flow rate of the oil thus pumped into the lubricating circuit.

Let it then be assumed that the motor control valve 26 has now been shifted to the right. The pressurized fluid from the first pump 28 flows through the conduit 62 to the motor 30 for causing its rotation in a reverse direction. The pressurized fluid in the conduit 62 also acts on the release valve 50, shifting same to the open position. Actuated hydraulically via the thus opened release valve 50, the clutch brake 18 disengages the one-way clutch 16 for the transmission of the reverse rotation of the motor 30 through the first planetary drive 14.

As upon leftward shifting of the motor control valve 26, the shuttle valve 36 applies part of the output of the first pump 28 to the selector valve 32 as the pilot signal. The pilot-actuated selector valve again blocks communication between the second pump 34 and the freewheel brake 22 of the final planetary drive 20, so that the freewheel brake holds the planet carrier 56 against rotation under spring pressure. Accordingly, with the shifting of the motor control valve 26 to the right, the planetary drives 14 and 20 become conditioned to impart the reverse rotation of the motor 30 to the winch drum 24 at a reduced speed. The drum revolves in the pay-off direction. During such revolution of the drum the selector valve 32 directs the pressurized fluid from the second pump 34 toward the lubricating circuit within the casing of the planetary drives 14 and 20.

Although the foregoing description of construction and operation is limited to the primary winch assembly 10 and its control system, it will be seen, upon inspection of the Drawing, that the secondary winch assembly 12 and its control system are of similar construction and operation. Only the pumps 28 and 34 and the relief valve 70 are common to both control systems. It will also be understood that the inventive concepts are applicable to only one winch assembly and not necessarily to a combination of two winch assemblies as in the disclosed embodiment.

What is claimed is:

1. A hydraulic control system for a reversible hoisting winch, wherein the winch has a spooling drum driven by a bidirectional hydraulic motor via planetary drive means including a brake which is responsive to fluid pressure actuation to allow the drum to freewheel, the control system comprising:

(a) a first source means of hydraulic fluid under pressure;

(b) a motor control valve for controlling communication between the first pressurized fluid source means and the bidirectional hydraulic motor in order to set the motor into and out of rotation in either of opposite directions;

(c) a second source means of hydraulic fluid under pressure for supplying pressurized fluid for lubrication purposes when the hydraulic motor is in rotation in either direction, and for conditioning the spooling drum for freewheeling when the motor control valve is in neutral;

(d) a pilot-operated selector valve normally positioned to cause the pressurized fluid from the second source means to be used for the actuation of the brake of the planetary drive means and responsive to a pilot signal to cause the pressurized fluid from the second source means to be used for the lubrication of the winch; and (e) means for applying the pilot signal to the pilot-operated selector valve in response to the delivery of the pressurized fluid from the first source means to the hydraulic motor, for the actuation of the motor in either direction, via the motor control valve.

2. The hydraulic winch control system of claim 1, wherein the applying means comprises a shuttle valve connected between a pair of conduits extending between the motor control valve and the bidirectional hydraulic motor, the shuttle valve being adapted to use as the pilot signal a fraction of the pressurized fluid being delivered from the first source means to the hydraulic motor.

3. The hydraulic winch control system of claim 1, further comprising a variable pressure reducing valve connected between the pilot-operated selector valve and the brake of the planetary drive means.

4. The hydraulic winch control system of claim 1, further comprising a relief valve for limiting the output fluid pressure of the second source means.

* * * * *